United States Patent [19]

Anderson

[11] 4,106,317

[45] Aug. 15, 1978

[54] FREEZER LOCK ASSEMBLY WITH KEY EJECTING MECHANISM

[75] Inventor: Bruce W. Anderson, Arlington Heights, Ill.

[73] Assignee: Illinois Tool Works Inc., Chicago, Ill.

[21] Appl. No.: 803,095

[22] Filed: Jun. 6, 1977

[51] Int. Cl.[2] ..... E05B 17/00

[52] U.S. Cl. ..... 70/388

[58] Field of Search ..... 70/388, 414, 139, 346, 70/347, 349, 356, 360, 363

[56] References Cited

U.S. PATENT DOCUMENTS

| | | | |
|---|---|---|---|
| 3,465,557 | 9/1969 | Ryder | 70/139 |
| 3,670,540 | 6/1972 | Fernandez | 70/421 |
| 3,748,881 | 7/1973 | Erickson | 70/388 |
| 3,995,463 | 12/1976 | Mikos | 70/388 |

*Primary Examiner*—Robert L. Wolfe

*Attorney, Agent, or Firm*—Jack R. Halvorsen; Robert W. Beart

[57] ABSTRACT

A lock having a low co-efficient of thermal conductivity for use with appliances having a large thermal differential between their interior and exterior. The lock includes a self-mounting body having an axial bore therethrough, a rotatable latch carrying a plug located in said bore and a constantly axially spring-urged key ejector means which carries locking means cooperating with complementary means in said body.

20 Claims, 16 Drawing Figures

Fig. 4
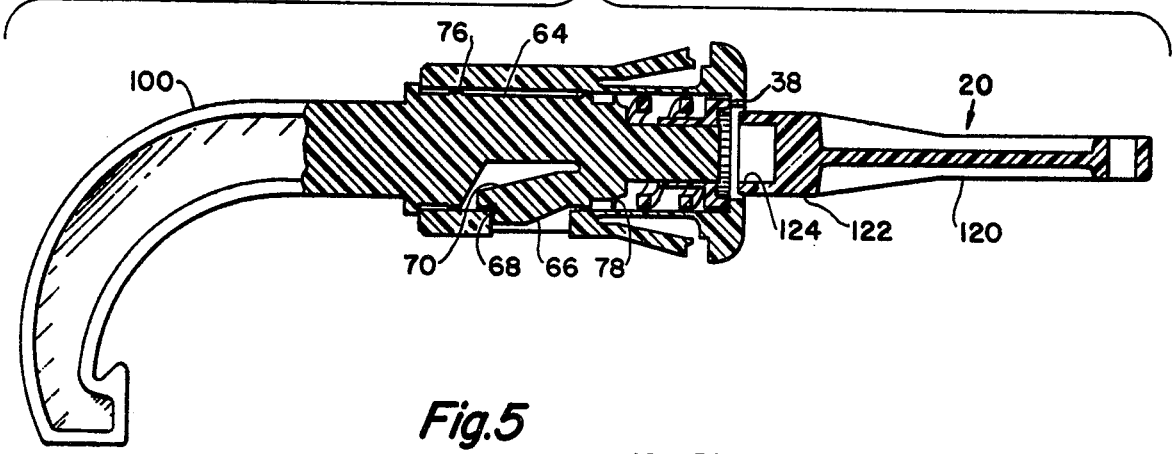
Fig.5
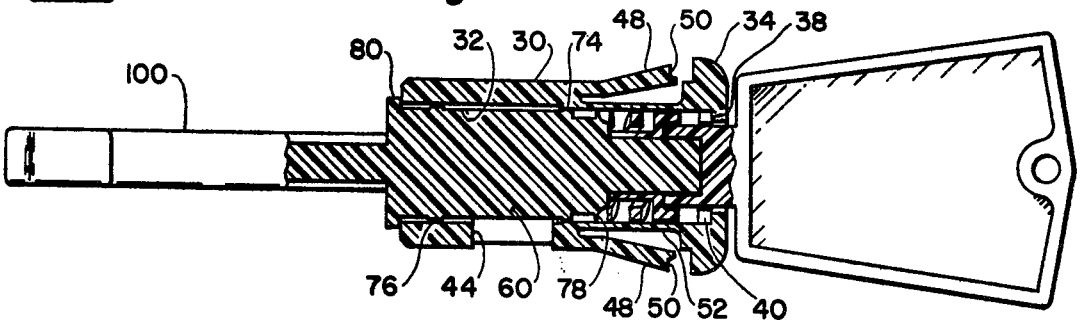
Fig.7
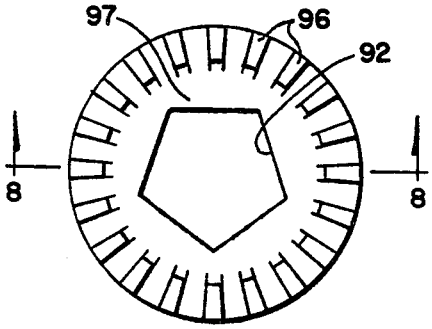
Fig.6
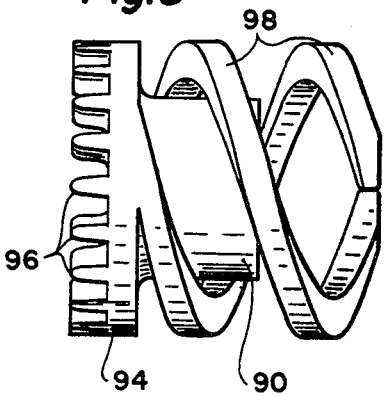
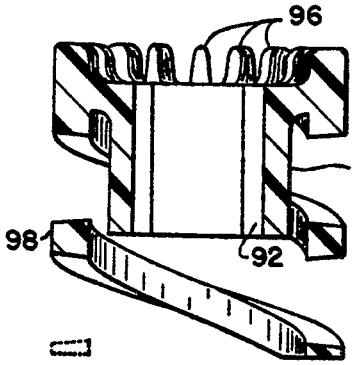
Fig.8

Fig. 9
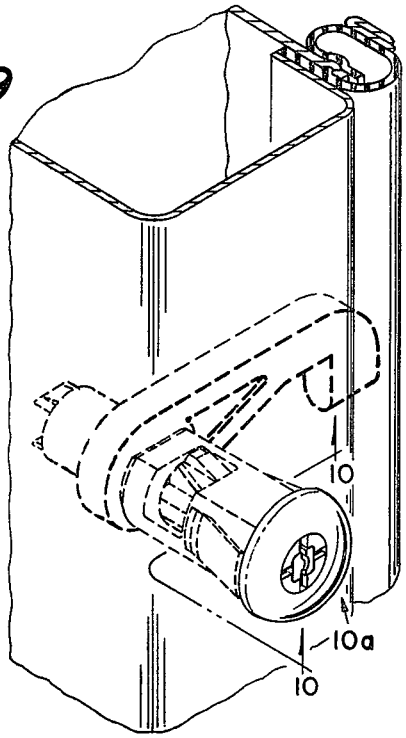
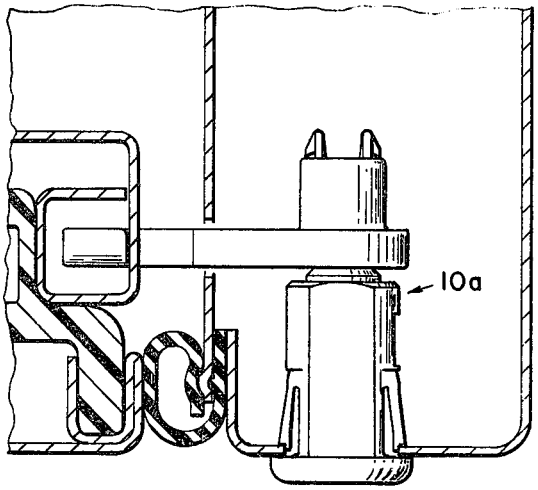
Fig. 10
Fig. 11
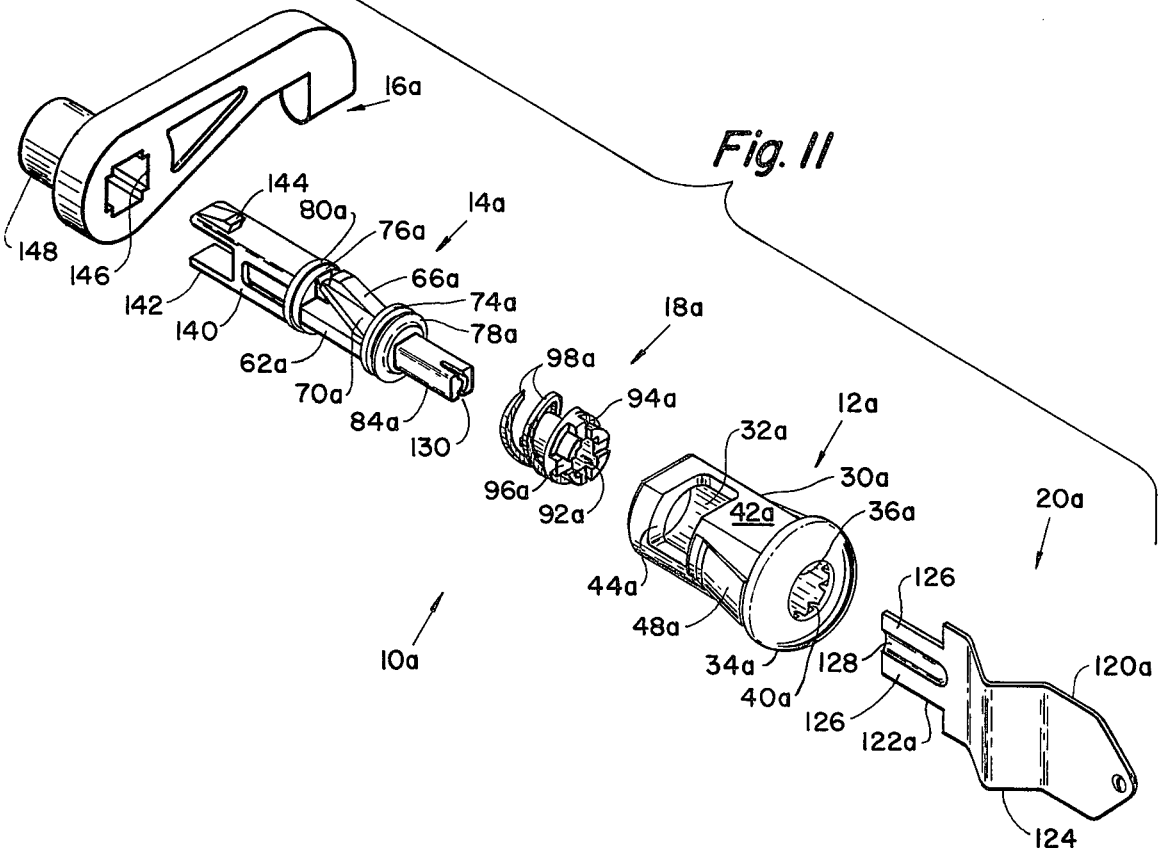

Fig. 12
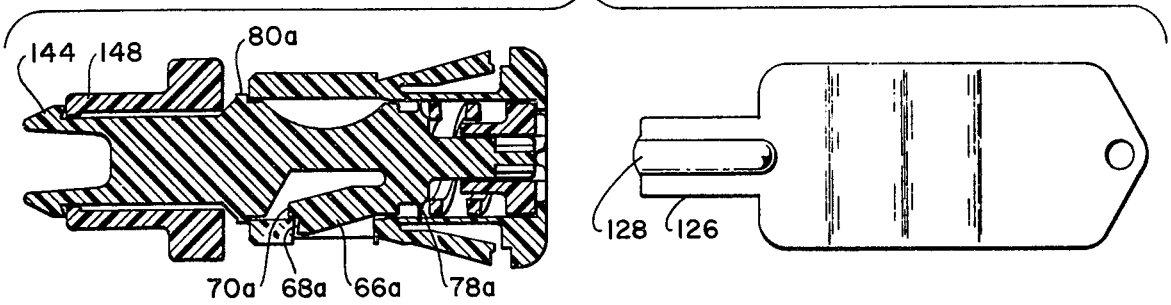
Fig. 13
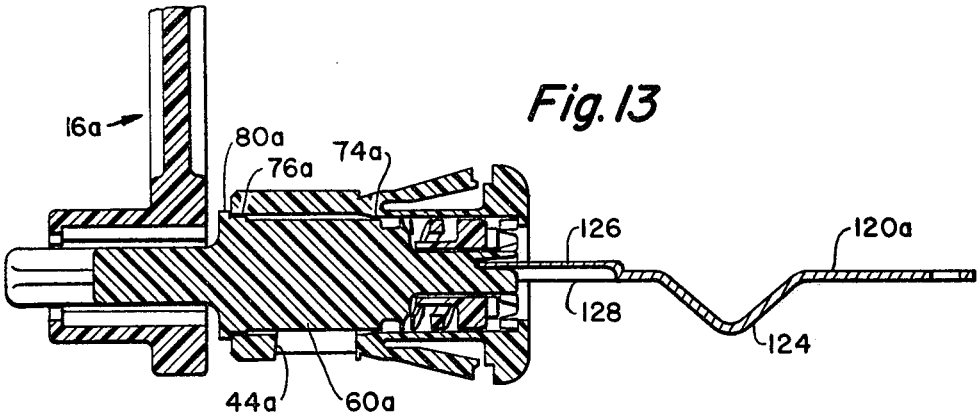
Fig. 15
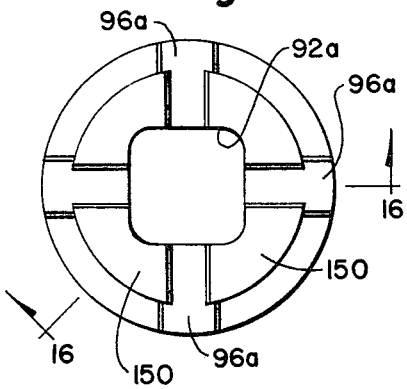
Fig. 14
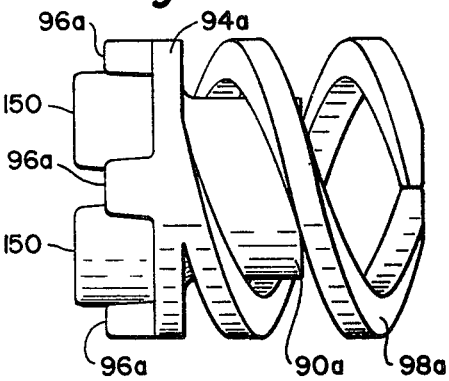
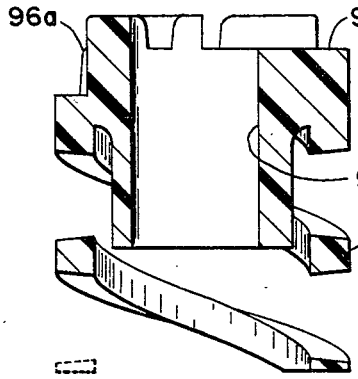
Fig. 16

FREEZER LOCK ASSEMBLY WITH KEY EJECTING MECHANISM

BACKGROUND OF THE INVENTION

Locks having a low co-efficient of thermal conductivity have been previously known as evidenced by the U.S. patent to Ryder U.S. Pat. No. 3,465,557 issued Sept. 9, 1969, and means for ejecting keys as an integral part of the lock have been disclosed in U.S. patents such as the patent to Erickson U.S. Pat. No. 3,748,881 issued July 31, 1973. While each of these locks function in a satisfactory manner, there were deficiencies in them, to the extent that they were expensive, had a multiplicity of parts and occasionally the metallic elements in the form of springs and tumbler members became affected by the thermal differential environment in which they were located.

SUMMARY OF THE INVENTION

The present invention is directed to a device for overcoming the deficiencies of the prior art, namely a minimum number of parts, the ability to fabricate such parts from thermoplastic materials which have low co-efficients of thermal conductivity and ease in assembly both as to the lock per se as well as in its application to the environment in which it is used.

It, therefore, is an object of the present invention to provide a locking means having a low co-efficient of thermal conductivity by utilizing thermoplastic materials in the fabrication of substantially all of the parts.

A further object of the present invention is to provide an inexpensive, readily assembled lock having a minimum number of parts which can be easily and fool proof-wise assembled by unskilled labor.

These and other objects will become apparent to those skilled in the art when the specification is read in conjunction with the attached drawing.

BRIEF DESCRIPTION OF THE DRAWINGS

FIG. 4 is a plan view in section of the embodiment shown in FIG. 1 with the key being spaced prior to insertion and activation of the lock;

FIG. 5 is a similar sectional view with the key inserted and the latch being rotated 90° from the position shown in FIG. 4;

FIG. 6 is a side elevational view of the combination key ejector and locking mechanism;

FIG. 7 is an end view of the device shown in FIG. 6;

FIG. 8 is an elevational view in partial section as viewed along 8—8 in FIG. 7;

FIG. 9 is a perspective view in partial section of a second preferred embodiment of the present invention;

FIG. 10 is a partial sectional view taken along line 10—10 of FIG. 9;

FIG. 11 is an exploded perspective view of this second preferred embodiment of the present invention;

FIG. 12 is an exploded sectional plan view of the present invention with the key being positioned for insertion in the lock;

FIG. 13 is a sectional view similar to FIG. 12 but with the key being inserted into the lock and the lock and latch mechanism rotated 90°;

FIG. 14 is an elevational view of the key ejector/-locking mechanism of this embodiment;

FIG. 15 is an end view of the device shown in FIG. 14; and

FIG. 16 is an elevational view in section taken along lines 16—16 of FIG. 15.

DETAILED DESCRIPTION

Figure 1:
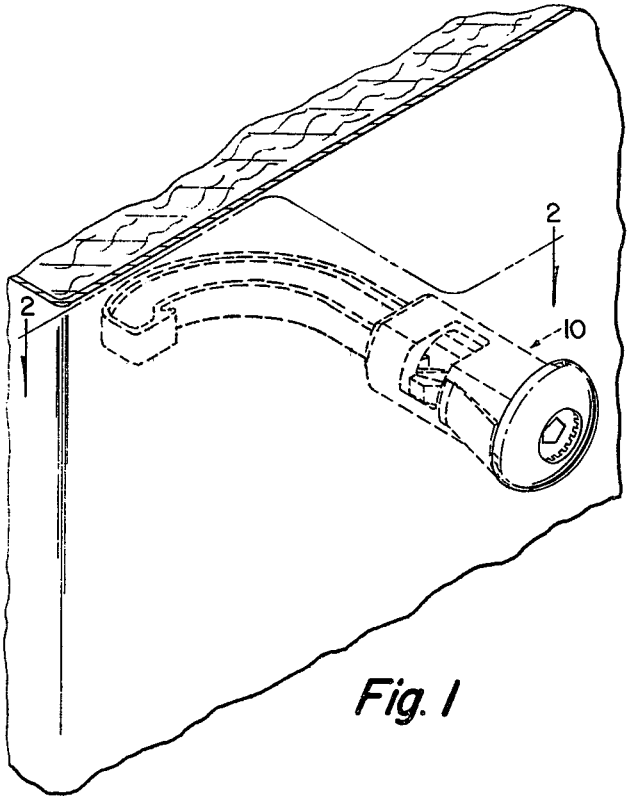
FIG. 1 is a perspective view in partial section of a preferred embodiment of the present invention as shown in applied form.

Referring now to the drawings wherein similar reference numerals are used to designate similar parts, a key ejecting lock mechanism 10 of the type contemplated by the present invention includes a body member 12, plug means or barrel 14, a latch or bolt 16, an ejecting-/locking mechanism 18 and a suitable key operating means 20.

Figure 2:
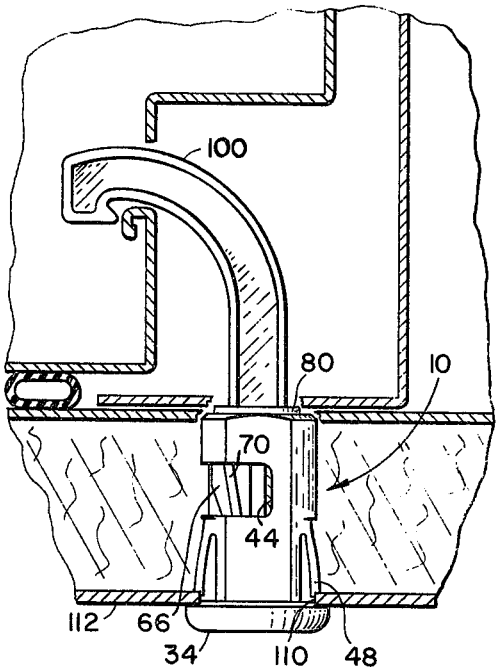
FIG. 2 is a partial sectional view taken along line 2—2 of FIG. 1.
Figure 3:
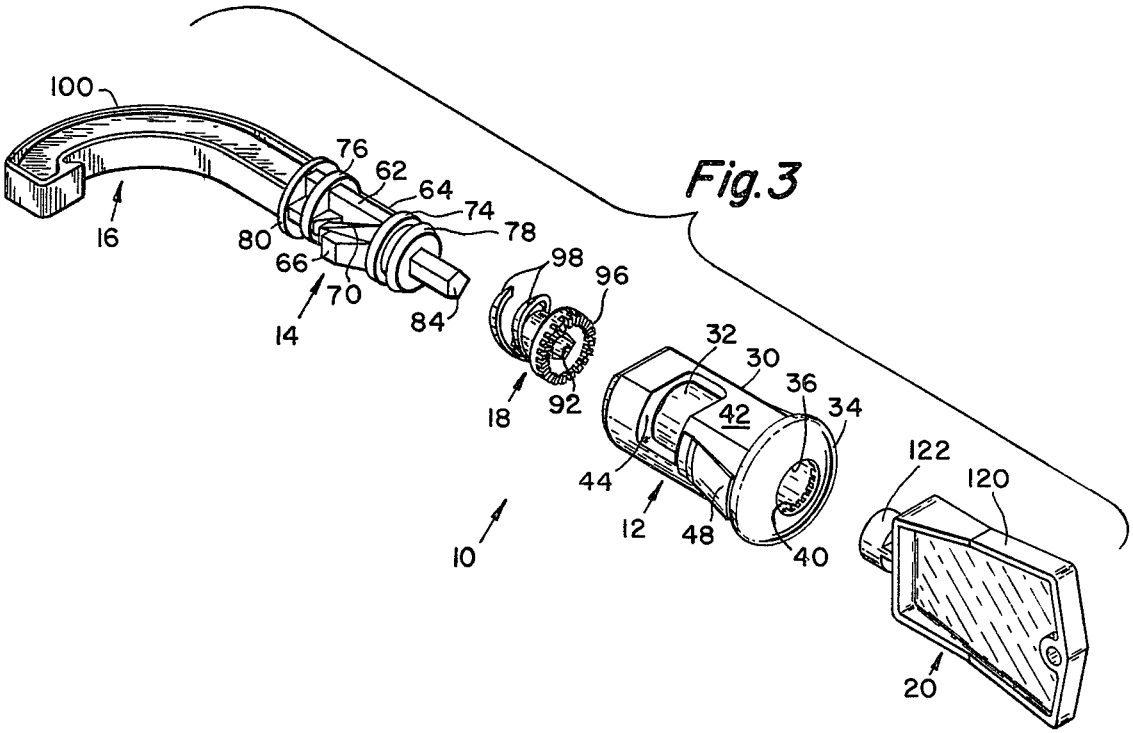
FIG. 3 is an exploded perspective view of the elements of the embodiment shown in FIGS. 1 and 2.

The body member 12 serves as the mounting means for the lock mechanism. It includes a tubular main portion 30 having a hollow bore 32 passing throughout the entire length of the body with a laterally extending flange or face piece 34 at one end, said face piece 34 having a reduced diameter aperture 36 co-axial with the bore 32 and forming an inwardly directed shoulder 38. The shoulder 38 carries a plurality of axially extending, circumferentially spaced engaging means or locking teeth 40, for purposes best set forth hereinafter. The body 30 is provided with opposed flat faces 42 for use in restraining rotation of the device in mounted position. A slot 44 intersects the wall of the body 30 and communicates with the inner bore 32. The slot 44 has a predetermined angular extent and in the present instance provides an included angle of approximately 90°. The main body portion 30, in this embodiment, has one or more resilient spring arms 48 provided with shoulder means 50 at their extremities in opposition to the underside of the flanged head 34. Additionally, the body is generally recessed at 52 so that when the spring arms 48 are compressed during insertion in an apertured workpiece they will be accepted within the recess 52 until the flange 34 is brought into engagement with an outer face of the workpiece, the shoulders 50 being spaced from the underside of the flange 34 a distance approximately equal to the thickness of the workpiece, and thence the arms 48 will spring outwardly to underlie the workpiece, as best seen in FIG. 2. It will be appreciated that the body could be provided with a groove adjacent the undersurface of the flanged head 34, not shown, in place of the arms 48, and a suitable C-ring snap fastener utilized for mounting the body relative to the workpiece.

The plug means or barrel 14 is a one-piece elongated member having a main body portion 60, in the present instance consisting of a central columnar portion 62 and a reinforcing rib 64 extending along one side thereof. Extending outwardly from the opposite side of columnar member 62 is a resilient retaining means or leg 66 presenting shoulder means 68 and an underlying flat blade-like portion 70 having a greater axial length and breadth than the locking leg 66, for purposes best set forth hereinafter. At opposite ends of the body 60 are a pair of circumferential flanges 74 and 76, each of said flanges 74 and 76 having a diameter substantially equal to the diameter of the bore 32 and complementarily accepted therein for rotation with the bore 32. Adjacent flange 74 and axially spaced therefrom is a flexible sealing flange 78 having a diameter slightly in excess of bore 32 whereby it will flex when inserted therein and serve as a sealing member. At the opposite end of main portion 60 and axially spaced from flange 76 there is located a fourth flange means 80 having a diameter greater than the diameter of bore 32 and adapted to abut the end of main body portion 30 opposite the flange head 34. The flange 80 is spaced from the shoulder means 68 a distance substantially equal to the distance from the end of main body portion 30 to the edge of slot 44 closest adjacent to that end of the body 30. Projecting co-axially from one end of the main portion 60 is an integral driver means in the form of a non-circular shaft 84, in the present instance the shaft 84 having a pentagonal configuration.

Mounted on driver shaft 84 is the spring loaded key ejecting/locking mechanism 18. Mechanism 18 in this embodiment is a one-piece device having a generally cylindrical sleeve 90 provided with a non-circular bore 92 complementary to the shaft 84, in this instance pentagonal. Extending laterally from sleeve 90 is a flanged head 94 carrying on its exposed face a plurality of circumferentially spaced teeth 96 that are complementary to the interdental spacing of teeth 40 that extend axially within bore 32. The outside diameter of flanged head 94 is complementary to and acceptable for rotation within the bore 32. Spring means 98 encircles the sleeve 90 and extends axially beyond the free end thereof. In this embodiment the spring element 98 is a twin helix integrally connected to the underface of the flanged head 94. The normal unstressed length of spring 98 is substantially greater than the axial length of the shaft 84, as will be explained hereinafter.

In this embodiment the latch or bolt means 16 is formed integral with the plug means or barrel 14 and extends axially from the flange 80 and then curves to form a hook-like element 100. It will be appreciated by those skilled in the art that the latch means 16 and its hooked portion 100 are a matter of design choice for the particular application and structure with which the locking mechanism is to be utilized. As will be seen, the second embodiment incorporates a different approach to this end of the lock and should be considered to be applicable to this style of lock as well.

To assemble the lock 10 the ejecting/locking mechanism 18 is mounted on the driver shaft 84 and the plug means 14 with its mounted mechanism 18 is telescoped within the bore 32 of body 30. The spring leg 66 is depressed as it encounters the end of the bore and the barrel 14 is located by flange 74 until the spring leg 66 and its shoulder 68 reach the lower edge of slot 44 whence the spring leg 66 springs outwardly to bring its back-up flange 70 into engagement with the wall of the bore 32. As was previously pointed out, the flange 80 will ride on the end of body 30 opposite flanged head 34 and in cooperation with shoulder 68 permits rotation of the body 60 within the bore. The teeth 96 carried on the head 94 are brought into engagement with the teeth 40 extending axially from the shoulder means 38, as best seen in FIG. 4.

The three piece assembly is then mounted in aperture 110 of the workpiece 112. Normally the hooked arm 100 would be inserted in a position approximately 90° from that shown in FIG. 2 which is primarily the locked position as illustrated.

To operate this lock mechanism there is provided a suitable key operating means 20 having a handle 120 a sleeve 122 and a non-circular counterbore 124 that is complementary to the shaft 84, in this instance pentagonal in section. To operate the lock the key 20 is positioned in axial alignment with the bore 36 in head 34, as seen in FIG. 4, and is moved axially within the bore 36 until it engages the upper face 97 that surrounds the bore 92 and is spaced inwardly from the teeth 96. Axial movement of the key within the lock compresses the spring 98, disengages the teeth 96 from the complementary teeth 40 and permits rotation of the body 60 within the bore 32. The limits of such rotation are defined by the angular extent of slot 44 and the engagement of the spring leg 66 within said slot 44. In the present embodiment the slot 44 permits a quarter turn or approximately 90° rotation of the locking hook 100. A distinct advantage of the present invention is the fact that with the large number of teeth 96 the removal of an axial force on key 20 will cause the spring 98 to react and axially eject the key at a multiplicity of positions between the locked and unlocked position. This embodiment utilizes a pentagonal shape on the shaft 84 and the bore 124 of the key 20 whereby standard tools or pliers cannot be used to tamper with the lock. To facilitate rapid assembly of the parts, regardless of orientation of the ejecting-/locking mechanism 18, there are 20 teeth 96 provided on mechanism 18 while there are also 20 teeth 40 projecting into the bore 32. This permits rapid assembly of the three parts by unskilled labor and also insures that in all positions the key 20 will be ejected from the lock for safety purposes and requires the user to carefully store the key to prevent inadvertent opening of the appliance, which in this case is normally a freezer chest or box and thereby eliminate the possibility of small children gaining access thereto.

In the present embodiment all four pieces are fabricated of injection molded thermoplastic material. This provides the low co-efficient of thermal conductivity that is desired in such applications.

Referring now to FIGS. 9 through 16 there is illustrated a second embodiment of the present invention wherein similar parts will be designated by similar numerals with the addition of the suffix "*a*." In this embodiment the lock mechanism **10*a* is quite similar to the first embodiment described in that it includes a body member 12*a* having a tubular main portion 30*a* provided with flats 42*a* to prevent rotation when assembled in an apertured workpiece. At one end of the main portion 30*a* is a flanged head 34*a* having a central bore 36*a* communicating with and being smaller in diameter than the main bore 32*a* that traverses the main portion 30*a*. Extending axially from head 34*a* adjacent the bore 36*a* are a plurality of circumferentially spaced teeth 40*a*. Intermediate the extremity of tubular main portion 30*a* is an angularly disposed slot 34 that communicates with the bore 32*a* and adjacent thereto are one or more resilient arms 48*a* for mounting the body portion 12*a*** in the apertured workpiece.

In this embodiment the plug means or barrel **14*a* includes a main body portion 60*a* having at one end thereof a locating flange 74*a* and an adjacent axially spaced sealing flange 78*a* while at the opposite end there is a complementary flange 76*a* adapted to be located and accepted within the bore 32*a* and an annular shouldered flange 80*a* for abutting the end of the main tubular portion 30*a* opposite to the flanged head 34*a*, similar to the first embodiment. Likewise, there is also provided a resilient leg 66*a* having shoulder means 68*a* for cooperation with one edge of the slot 44*a*, plus a back-up flange 70*a* which operates in the same fashion as the first embodiment in that it prevents leg 66*a* to be overstressed and popped out of slot 44*a*. In this embodiment the axially extending shaft 84***a* is also non-circular and more particularly is square in configuration. As opposed to the first embodiment, however, driver shaft 84*a* is provided with a slot 130 which extends axially from the end face. Slot 130 for safety reasons and also to preclude tampering is a non-linear slot, i.e. it is provided with straight edges and a curved center portion to eliminate the possibility of using a screwdriver or similar tool for operation of the lock.

In this embodiment the plug means or barrel 14*a* at its end opposite to the shaft 84*a* carries a non-circular extension 140 having a pair of resilient axially extending elements 142 that each carry one or more snap catches 144 thereon. The latch or bolt 16*a* is an independent member having a complementary bore 146 that passes through the latch 16*a* and a reinforcing hub 148. The bore 146 is acceptable on the axial extension 140 and is adapted to flex the elements 142 inwardly until the snap catches 144 are located on the opposite side of the hub 148 and with the latch in engagement adjacent flange 80*a*. This configuration provides adaptability in that a single lock mechanism is capable of accepting a plurality of differently configured latches 16*a* which are designed to be accepted by the particular structure of the freezer mechanism with which it is to be utilized.

In this embodiment the ejecting/locking mechanism 18*a* includes a sleeve 90*a* having a non-circular bore 92*a* extending therethrough. In this instance the bore 92*a* is substantially square in configuration to be complementary to the driver shaft 84*a*. In this embodiment the head 94*a* carries four locking teeth 96*a* spaced in quadrature and extending axially from the outer face of head 94*a*. Also included in this embodiment are a plurality of axially extending segments 150 that have a curved outer edge, the diametral extent of which is substantially equal to the bore 36*a* in head 34*a* and serve as locating means therein. As with the prior embodiment, the mechanism 18*a* includes spring means in the form of a helically disposed spring element 98*a*. It will be recognized that the interdental spacing between the teeth 40*a* in the main body member 12*a* is such that they will readily accept the teeth 96*a* at a plurality of positions, in the present instance there being 12 of the teeth 40*a*.

The assembly of this device is substantially identical to the prior embodiment in that the ejecting/locking mechanism 18*a* is telescoped onto the driver shaft 84*a* and the plug means 14*a* is telescoped within the bore 32*a* of the body member 12*a* until the spring leg 66*a* is captured within slot 44*a* and the flange 80*a* abuts the end opposite the head 34*a*, as seen in FIG. 12. The latch 16*a* can be preassembled to the plug means 14*a* either before assembly with the body 12*a* or subsequent thereto.

In this embodiment the suitable key operating means 20*a* includes a gripping or handle means 120*a* reinforced by a transverse rib 124 and having a non-linear blade means 122*a* complementary to the slot 130. Basically the blade means 122*a* includes flat edge portions 126 and an axially disposed curvalinear rib 128 that is complementary in curvature to the curve in slot 130. It should be noted that the overall width of the engaging means 122*a* of key 20*a* is substantially greater than the side-to-side measurement of driver shaft 84*a* whereby when the key 20*a* is axially moved into the lock it will overlap the edges of shaft 84*a* and engage the end face of the ejecting/locking mechanism 18*a*. The operation of the lock is substantially identical to the previously described embodiment in that axial movement of the key disengages the teeth 96*a* from the teeth 40*a* while the spring means 98*a* provides a reaction force against the key so that it cannot in any position remain within the lock and thereby be overlooked by the owner of the freezer. Such constant ejection of the key insures that its presence will be known in all circumstances and thus will not be available for small children to use and thereby have access to the interior of the freezer.

It will be appreciated by those skilled in the art that for additional sealing means an O-ring, not shown, could be positioned between the sealing flange 78*a* and the locating flange 74*a* to further add to the seal capabilities of the lock. Further, in certain instances the design of the freezer chest may be such that it would preclude the heavy body sections of an all plastic latch 16*a*. Therefore, it is contemplated that the latch could be fabricated from rigid thin sheet metal having a hook shape configuration and provided with suitable hub and bore means similar to those shown at 146 and 148. The location of such a latch of sheet metal within a freezer chest would not affect the thermal conductivity of this lock mechanism. Also the key 20 in the first embodiment could be formed of die-cast material rather than plastic material.

It will be appreciated that Applicant has provided a locking mechanism fabricated from injection molded, thermoplastic members which can be easily assembled by unskilled labor, is readily adaptable to a multiplicity of environments and is economical to fabricate. It provides safe, tamper-proof means for controlling access to freezer chests and through it the mechanism of its constant ejecting forces acting on the key precludes the possibility of the key being inadvertently left in the lock and made available to youngsters. It, therefore, eliminates the possibility of a small child having access to the interior of a freezer chest which could be inadvertently closed or locked by a playmate and result in suffocation therein.

While two embodiments of the preferred invention have been disclosed, it will be apparent to those skilled in the art that modifications thereto can be made.

I claim:

1. A lock having a low co-efficient of thermal conductivity adapted to be mounted in an apertured workpiece including a first body means having a bore therethrough and plug means rotatably mounted within said bore and having integral driver means adapted to directly and slidingly receive a key, resiliently urged key ejector means surrounding and coupled to said plug driver means and axially and rotationally moveable within said bore, and mutually engageable locking means carried by said ejector means and said body means for restraining rotation of said plug at predetermined angular locations.

2. A lock of the type claimed in claim 1 wherein all components of the lock are fabricated of thermoplastic material.

3. A lock of the type claimed in claim 1 wherein said body includes a laterally extending flanged head at one end for engaging one surface of said workpiece and means for engaging an opposite surface of said workpiece to retain said body in mounted relation thereto.

4. A lock of the type claimed in claim 3 wherein said means for engaging includes at least one integral resilient shouldered arm.

5. A lock of the type claimed in claim 1 wherein said body includes circumferentially disposed slot means communicating with said bore, said plug means having an integral deflectable arm positioned within said slot means to prevent axial movement of said plug relative to said body but permitting angular movement thereof between the limits of said slot means.

6. A lock of the type claimed in claim 1 wherein said body means bore has a predetermined diameter through a substantial portion of its axial extent and a restricted diameter flange adjacent one end of said bore, said plug means includes a first portion having circular bearing means for engaging the cylindrical walls of said predetermined diameter of said body bore, means for restraining axial movement between said plug and said body but permitting limited angular movement therebetween, said plug having an integral second non-circular portion which forms said driver means and extends co-axially from said first portion toward said restricted diameter, said key ejector means including a first element having a diameter less than said predetermined diameter but greater than said restricted diameter and a non-circular bore therethrough complementary to said plug second non-circular portion and adapted to be non-rotatably mounted relative to said plug second portion and for axial movement thereon within said body bore, said locking means carried by said ejector means first element and said restricted diameter flange, and second element spring means normally urging said locking means into engagement but responsive to key pressure axially against said first element to disengage said locking means and permit angular movement of said plug.

7. A lock of the type claimed in claim 6 wherein said key ejector means first and second elements are a one-piece integral device.

8. A lock of the type claimed in claim 6 wherein said non-circular second portion of said plug has more than three sides but less than six sides.

9. A lock of the type claimed in claim 8 wherein said second portion is substantially square in cross section.

10. A lock of the type claimed in claim 9 wherein said second portion includes an irregular non-straight transverse slot extending axially through a substantial extent of said second portion and adapted to accept a complementary key having portions extending laterally beyond the side margins of said second portion when the key is in said slot to thereby engage and axially move said key ejector first element.

11. A lock of the type claimed in claim 8 wherein said second portion is pentagonal in cross section.

12. A lock of the type claimed in claim 6 wherein said locking means includes a plurality of axially disposed protuberances carried by said first element of the key ejector and a plurality of complementary grooves carried by said flange.

13. A lock of the type claimed in claim 12 wherein said protuberances are generally radially disposed axially extending buttress-type teeth and said grooves are complementary thereto.

14. A lock of the type claimed in claim 13 wherein said teeth are four in number positioned in quatriture.

15. A lock of the type claimed in claim 13 wherein said teeth are twenty in number positioned in equally spaced relation adjacent the outer edge of said first element.

16. A lock of the type claimed in claim 11 wherein said pentagonal second portion is adapted to accept a pentagonal socket shaped key, said second portion lying at or below the end face of said first element in the locked position and exposed to engagement by said key when said ejector is axially moved by said key.

17. A lock of the type claimed in claim 6 wherein said means for restraining axial movement of said plug relative to said body includes a circumferentially disposed slot intermediate its length, said plug including a flange adjacent one end having a diameter greater than said predetermined diameter for bearing on one end of said body, resilient catch means extending laterally from said plug a predetermined distance from said flange and acceptable within said slot to restrain axial movement of the plug relative to the body but permitting rotational movement within the circumferential limits of said slot.

18. A lock of the type claimed in claim 1 wherein said plug means carries a latch means at its end opposite to the end thereof rotatably mounted in said body bore.

19. A lock of the type claimed in claim 18 wherein said latch means is integral with said plug.

20. A lock of the type claimed in claim 18 wherein said latch means is an independent member non-rotatably mounted in said plug.

* * * * *

UNITED STATES PATENT OFFICE

CERTIFICATE OF CORRECTION

Patent No. 4,106,317 Dated August 15, 1978

Inventor(s) Bruce W. Anderson

It is certified that error appears in the above-identified patent and that said Letters Patent are hereby corrected as shown below:

On the title page, item [ 21 ] 803,095 should read --803,505--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*